US011170706B1

(12) United States Patent
Lin et al.

(10) Patent No.: US 11,170,706 B1
(45) Date of Patent: Nov. 9, 2021

(54) PIXEL COMPENSATION CIRCUIT

(71) Applicants: AU OPTRONICS CORPORATION, Hsin-Chu (TW); National Cheng Kung University, Tainan (TW)

(72) Inventors: Chih-Lung Lin, Hsin-Chu (TW); Jie-An Lin, Hsin-Chu (TW); Ming-Yang Deng, Hsin-Chu (TW); Chia-En Wu, Hsin-Chu (TW)

(73) Assignees: AU OPTRONICS CORPORATION, Hsin-Chu (TW); NATIONAL CHENG KUNG UNIVERSITY, Tainan (TW)

( * ) Notice: Subject to any disclaimer, the term of this patent is extended or adjusted under 35 U.S.C. 154(b) by 0 days.

(21) Appl. No.: 17/237,794

(22) Filed: Apr. 22, 2021

Related U.S. Application Data

(60) Provisional application No. 63/037,293, filed on Jun. 10, 2020.

(30) Foreign Application Priority Data

Dec. 31, 2020 (TW) ..... 109147231

(51) Int. Cl.
*G09G 3/32* (2016.01)

(52) U.S. Cl.
CPC ..... *G09G 3/32* (2013.01); *G09G 2310/027* (2013.01); *G09G 2310/061* (2013.01)

(58) Field of Classification Search
CPC ..... G09G 3/32; G09G 2310/027; G09G 2310/061
See application file for complete search history.

(56) References Cited

U.S. PATENT DOCUMENTS

| | | | | |
|---|---|---|---|---|
| 9,343,014 | B2 | 5/2016 | Huang et al. | |
| 2006/0170628 | A1* | 8/2006 | Yamashita | G09G 3/3266 345/76 |
| 2006/0238135 | A1* | 10/2006 | Kimura | G09G 3/20 315/169.3 |
| 2018/0174931 | A1* | 6/2018 | Henley | G01R 31/2635 |
| 2018/0358339 | A1* | 12/2018 | Iguchi | H01L 33/62 |
| 2020/0152130 | A1* | 5/2020 | Hong | G09G 3/3233 |

FOREIGN PATENT DOCUMENTS

| | | | |
|---|---|---|---|
| CN | 111369935 | A | 7/2020 |
| TW | I712026 | B | 12/2020 |
| TW | I717996 | B | 2/2021 |
| WO | WO2020001027 | A1 | 1/2020 |

* cited by examiner

*Primary Examiner* — Andrew Sasinowski
(74) *Attorney, Agent, or Firm* — WPAT, PC

(57) ABSTRACT

A pixel compensation circuit including a light emitting diode, a drive unit, a control unit, a data write-in unit, a reset unit, and a pull-down unit is disclosed. The control unit is configured to control a voltage drop time of the first node according to a data voltage value received by the data write-in unit, so as to control a gray scale of the light emitting diode. The data write-in unit includes a first transistor, a second transistor, a third transistor and a capacitor. The first transistor is connected to a first voltage source and a second node. The second transistor is connected to the second node and a third node. The third transistor is connected to the third node and a data input source. The first capacitor is connected to the second node and a first reference voltage source.

10 Claims, 7 Drawing Sheets

200

100

100

100

100

100

PIXEL COMPENSATION CIRCUIT

RELATED APPLICATIONS

This application claims priority to U.S. Provisional Application Ser. No. 63/037,293, filed Jun. 10, 2020, and Taiwan Application Serial Number 109147231, filed Dec. 31, 2020, which are herein incorporated by reference in its entirety.

BACKGROUND

Technical Field

The present disclosure relates to a pixel compensation circuit. More particularly, the present disclosure relates to a pixel compensation circuit which uses a constant current to set the gray scale of a light emitting diode.

Description of Related Art

In order to produce LED backlight panels with uniform brightness, many methods have been proposed. However, when outputting high brightness, the voltage drop caused by the large current flowing through the driving transistor may make current control difficult. Although the problem of difficult current control can be solved by increasing the cross voltage of the driving transistor, the power consumption will be increased. In addition, since the micro-sized light emitting diode (mini LED) requires a larger drive current than a general organic light emitting diode, the voltage source is prone to offset due to the line resistance in the transmission path, which causes the voltage at the voltage source terminal of each pixel to be different, and an error occurred in the output current.

SUMMARY

One aspect of the present disclosure is related to a pixel compensation circuit, including a light emitting diode, a drive unit, a control unit, a data write-in unit, a reset unit, and a pull-down unit. The control unit is further configured to control a voltage drop time of the first node according to a data voltage value received by the data write-in unit, so as to control a gray scale of the light emitting diode. The data write-in unit includes a first transistor, a second transistor, a third transistor and a capacitor. A first end of the first transistor is connected to a first voltage source, and a second end of the first transistor is connected to a second node. A first end of the second transistor is connected to the second node, and a second end of the second transistor is connected to a third node. A first end and a control end of the third transistor are connected to the third node, and a second end of the third transistor is connected to a data input source. A first end of the first capacitor is connected to the second node, and a second end of the first capacitor is connected to a first reference voltage source.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
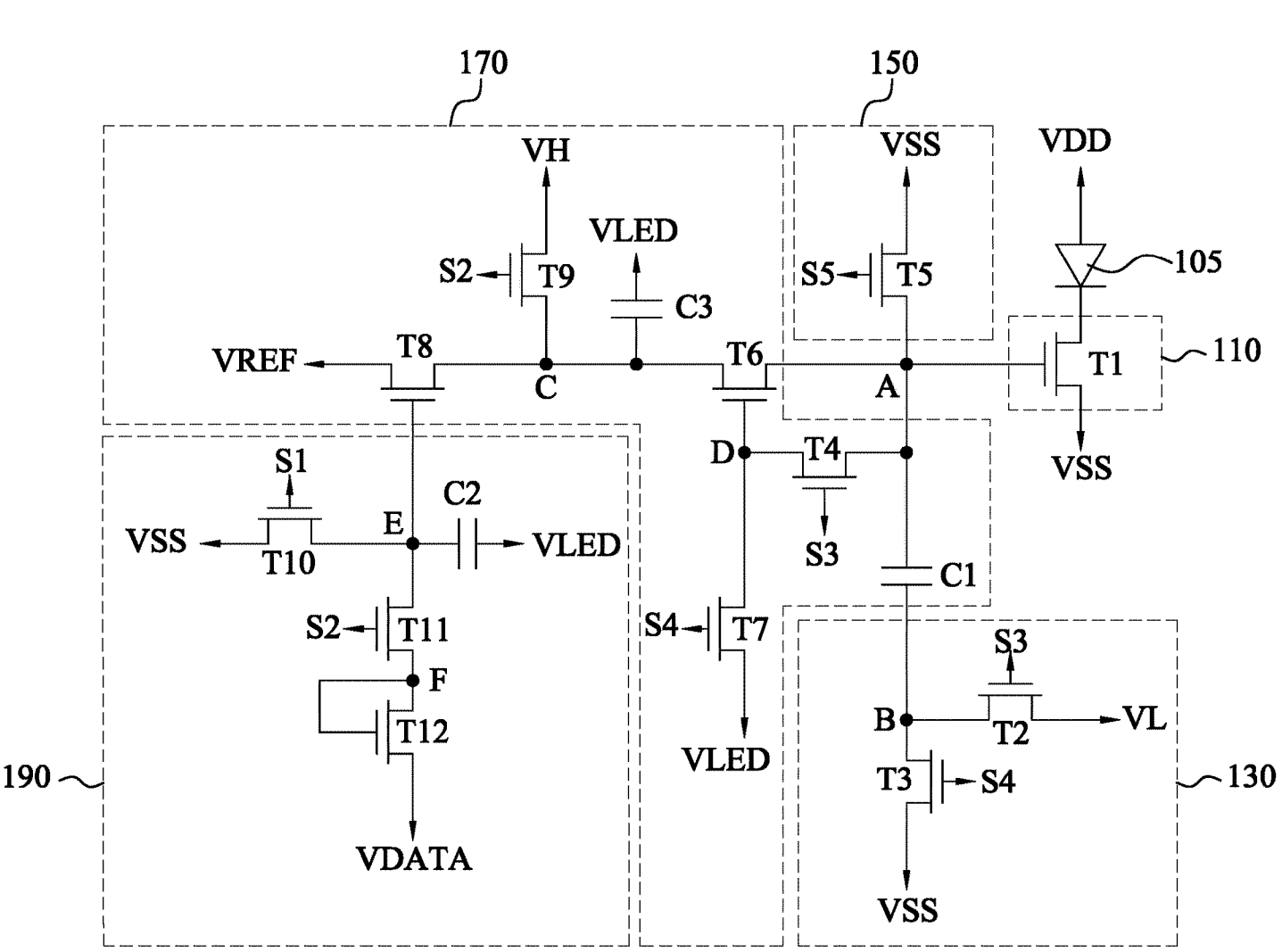
FIG. 1 is a schematic diagram illustrating a pixel compensation circuit according to some embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

It will be understood that, in the description herein and throughout the claims that follow, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Moreover, "electrically connect" or "connect" can further refer to the interoperation or interaction between two or more elements.

It will be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to.

It will be understood that, in the description herein and throughout the claims that follow, the phrase "and/or" includes any and all combinations of one or more of the associated listed items.

It will be understood that, in the description herein and throughout the claims that follow, unless otherwise defined, all terms (including technical and scientific terms) have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a schematic diagram illustrating a pixel compensation circuit 100 according to some embodiments of the present disclosure.

FIG. 1 is taken as an example. The pixel compensation circuit 100 includes a light emitting diode 105, a drive unit 110, a pull-down unit 130, a reset unit 150, a control unit 170 and a data write-in unit 190.

In the connection relationship, the light emitting diode 105 is connected to the drive unit 110. The drive unit 110, the reset unit 150 and the control unit 170 are all connected to the node A. The pull-down unit 130 is connected to the control unit 170. The data write-in unit 190 is connected to the control unit 170.

In detail, the drive unit 110 includes a transistor 110. The pull-down unit 130 includes a transistor T2 and a transistor T3. The reset unit 150 includes a transistor T5. The control unit 170 includes transistors T4, T6, T7, T8, T9 and capacitors C1, C3. The data write-in unit 190 includes transistors T10, T11, T12 and the capacitor C2.

In the connection relationship, an end of the light emitting diode 105 is connected to the voltage source VDD, and another end of the light emitting diode 105 is connected to the transistor T1. An end of the transistor T1 is connected to the light emitting diode 105, another end of the transistor T1 is connected to the voltage source VSS, and the control end of the transistor T1 is connected to the node A.

An end of the transistor T2 is connected to the low voltage source VL, and another end of the transistor T2 is connected to the node B. The control end of the transistor T2 receives a control signal S3. An end of the transistor T3 is connected to the node B, another end of the transistor T3 is connected to the voltage source VSS, and a control end of the transistor T3 receives the control signal S4.

An end of the transistor T5 is connected to the voltage source VSS, another end of the transistor T5 is connected to the node A, and the control end of the transistor T5 receives the control signal S5.

An end of the transistor T4 is connected to the node A, another end of the transistor T4 is connected to the node D, and the control end of the transistor T4 receives the control signal S3. An end of the transistor T6 is connected to the node A, another end of the transistor T6 is connected to the node C, and the control end of the transistor T6 is connected to the node D. An end of the transistor T7 is connected to the node D, another end of the transistor T7 is connected to the reference voltage source VLED, and the control end of the transistor T7 receives the control signal S4. An end of the transistor T8 is connected to the reference voltage source VREF, another end of the transistor T8 is connected to the node C, and a control end of the transistor T8 is connected to the node E. An end of the transistor T9 is connected to the high voltage source VH, another end of the transistor T9 is connected to the node C, a control end of the transistor T9 receives the control signal S2. An end of the capacitor C1 is connected to the node A, and another end of the capacitor C1 is connected to the node B. An end of the capacitor C3 is connected to the node C, and another end of the capacitor C3 is connected to the reference voltage source VLED.

An end of the transistor T10 is connected to the voltage source VSS, another end of the transistor T10 is connected to the node E, and a control end of the transistor T10 receives the control signal S1. An end of the transistor T11 is connected to the node E, another end of the transistor T11 is connected to the node F, and a control end of the transistor T11 receives the control signal S2. An end of the transistor T12 is connected to the node F, another end of the transistor T12 is connected to the data input source VDATA, and a control end of the transistor T12 is connected to the node F. An end of the capacitor C2 is connected to the node E, another end of the capacitor C2 is connected to the reference voltage source VLED.

Figure 2:
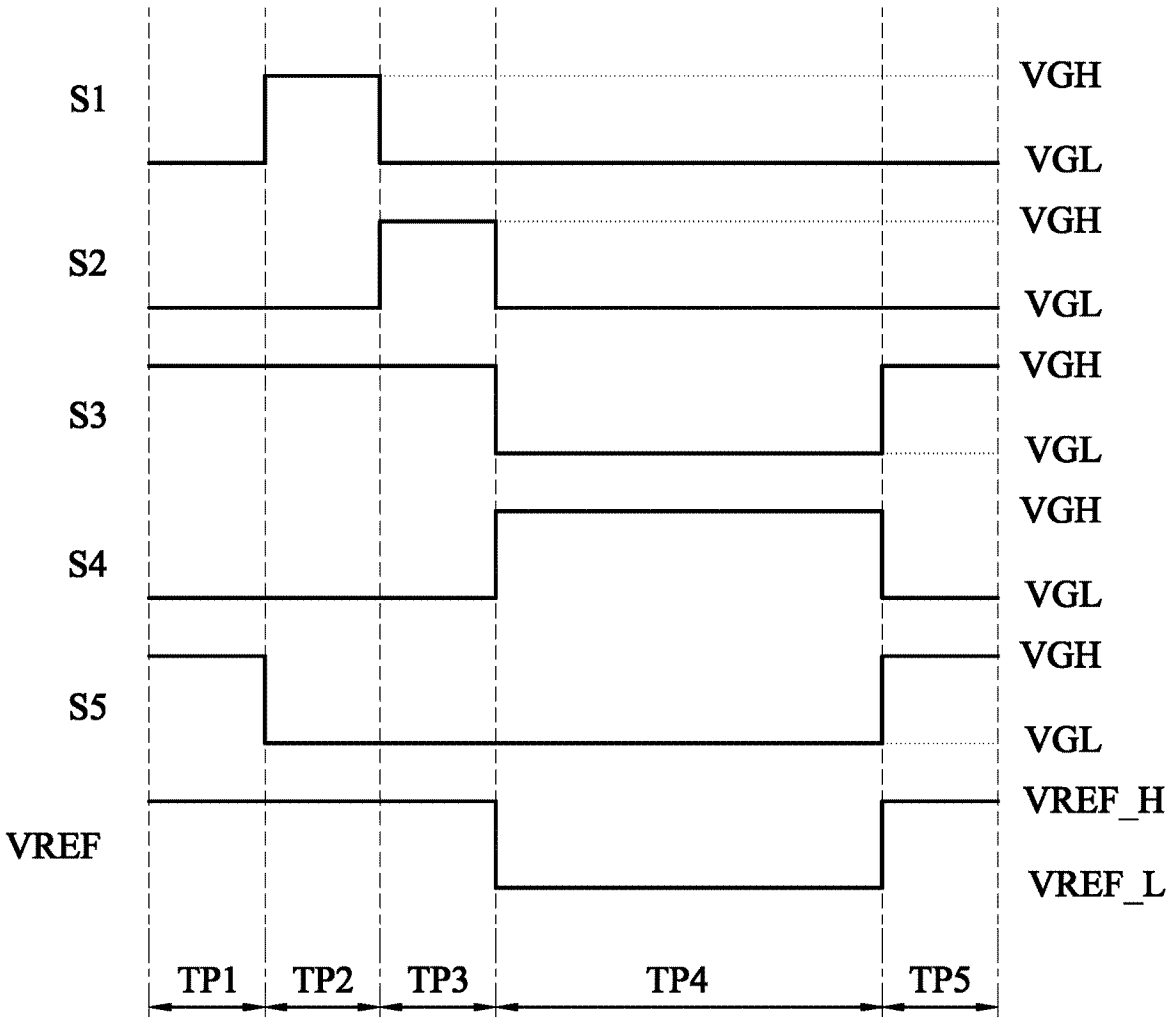
FIG. 2 is a schematic diagram illustrating an operation sequence of a pixel compensation circuit according to some embodiments of the present disclosure.

Reference is made to FIG. 2. FIG. 2 is a schematic diagram illustrating an operation sequence of a pixel compensation circuit according to some embodiments of the present disclosure. FIG. 2 is a schematic diagram illustrating an operation sequence 200 of a pixel compensation circuit 100 according to some embodiments of the present disclosure. The operation method of the pixel compensation circuit 100 in FIG. 1 will be explained with reference to FIG. 3 to FIG. 7.

Figure 3:
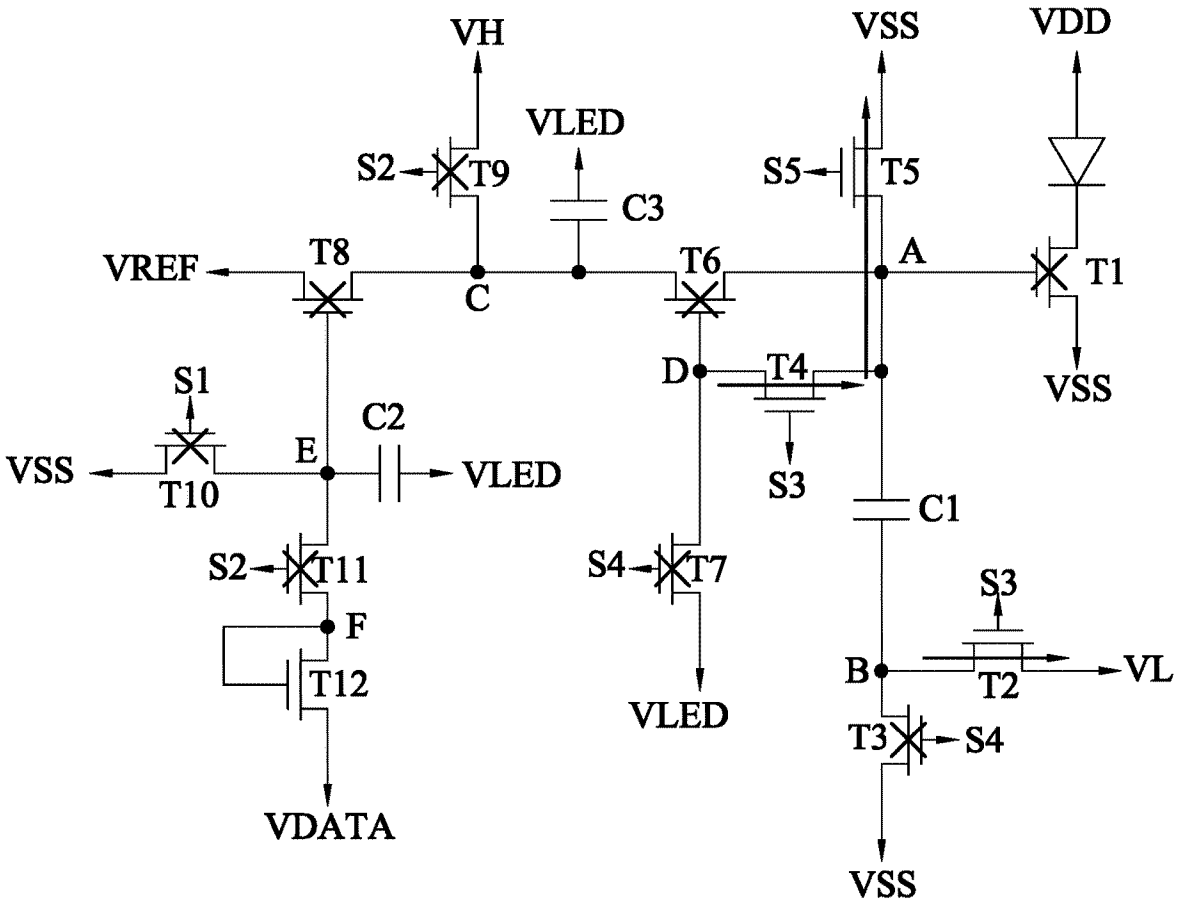
FIG. 3 is a schematic diagram illustrating an operation of the pixel compensation circuit illustrated in FIG. 1 in the time interval illustrated in FIG. 2.

Reference is made to FIG. 3. FIG. 3 is a schematic diagram illustrating an operation of the pixel compensation circuit 100 illustrated in FIG. 1 in the time interval TP1 illustrated in FIG. 2. The time interval TP1 is a reset time interval. In the time interval TP1, the control signals S1, S2, S4 are the low voltage values VGL, and the control signals S3, S5 are the high voltage values VGH, and the reference voltage source VREF is the high voltage value VREF_H.

Since the control signals S1, S2, S4 are the low voltage values VGL, the transistors T3, T7, T9, T10, T11 are not conducted, and the transistors T2, T4 and T5 are conducted. After the transistors T4 and T5 are conducted, a voltage value of the node A is the voltage value V_SS of the voltage source VSS. Since the voltage value V_SS of the voltage source VSS is a low voltage value, the transistor T1 is not conducted. Furthermore, since the transistor T2 is conducted, the voltage value of the node B is a voltage value V_L of the low voltage source VL.

Figure 4:
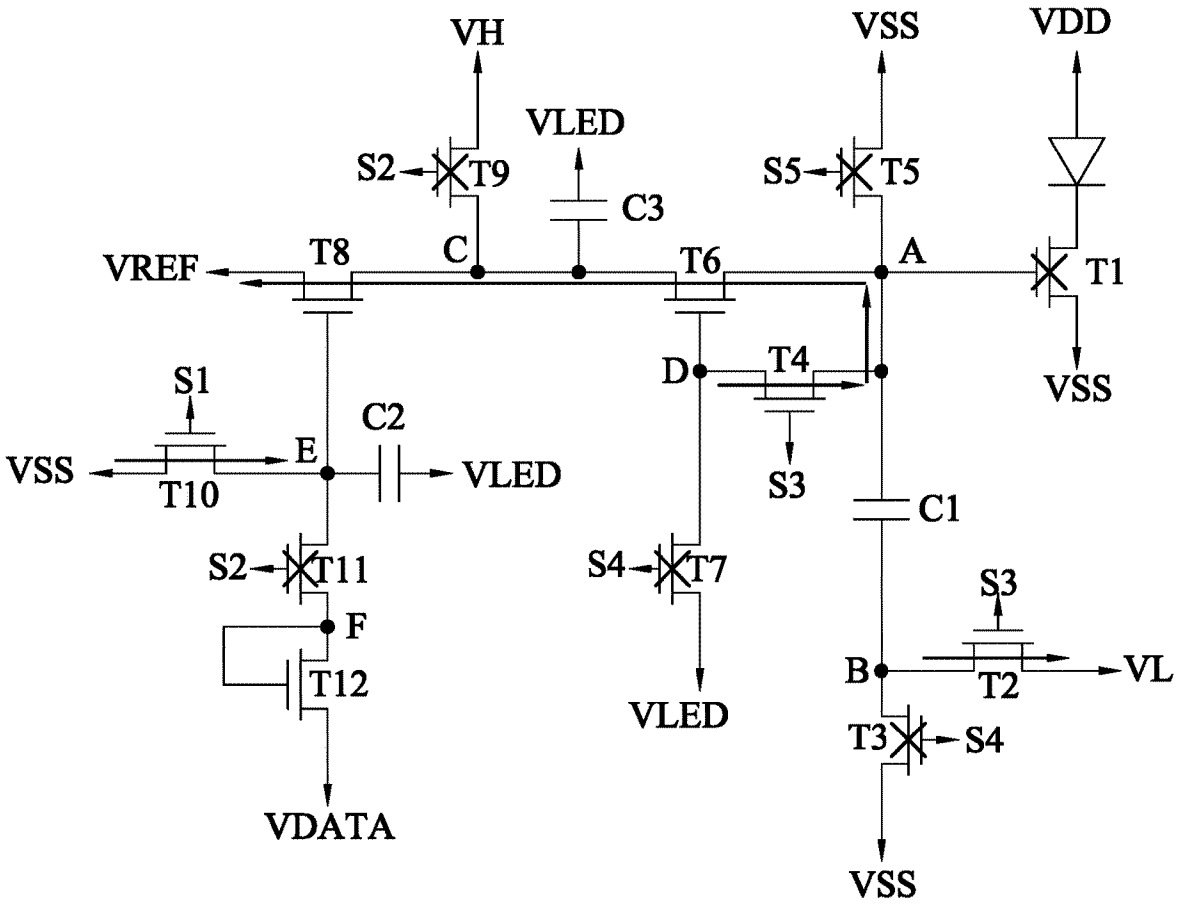
FIG. 4 is a schematic diagram illustrating an operation of the pixel compensation circuit illustrated in FIG. 1 in the time interval illustrated in FIG. 2.

Reference is made to FIG. 4. FIG. 4 is a schematic diagram illustrating an operation of the pixel compensation circuit 100 illustrated in FIG. 1 in the time interval TP2 illustrated in FIG. 2. The time interval TP2 is a compensation time interval. In the time interval TP2, the control signals S1, S3 are the high voltage values VGH, the control signals S2, S4 and S5 are the low voltage values VGL, and the reference voltage source VREF is the high voltage value VREF_H.

Since the control signals S2, S4 and S5 are the low voltage values VGL, the transistors T3, T5, T7, T9 and T11 are not conducted. Since the control signals S1, S3 are high voltage values VGH, the transistors T2, T4, T10 are conducted. Since the transistor T10 is conducted, the voltage value of the node E is the voltage value V_SS of the voltage source VSS. At this time, the voltage value of the node E is reset, and the transistor T8 is conducted. At this time, the voltage value of the node C is the voltage value VREF_H of the voltage source VREF. The voltage value of the node A and the voltage value of the node D are the voltage values VREF_H plus the threshold voltage VTH_T6 of the transistor T6. At this time, the transistor T6 matches and compensates the threshold voltage of the transistor T1.

Figure 5:
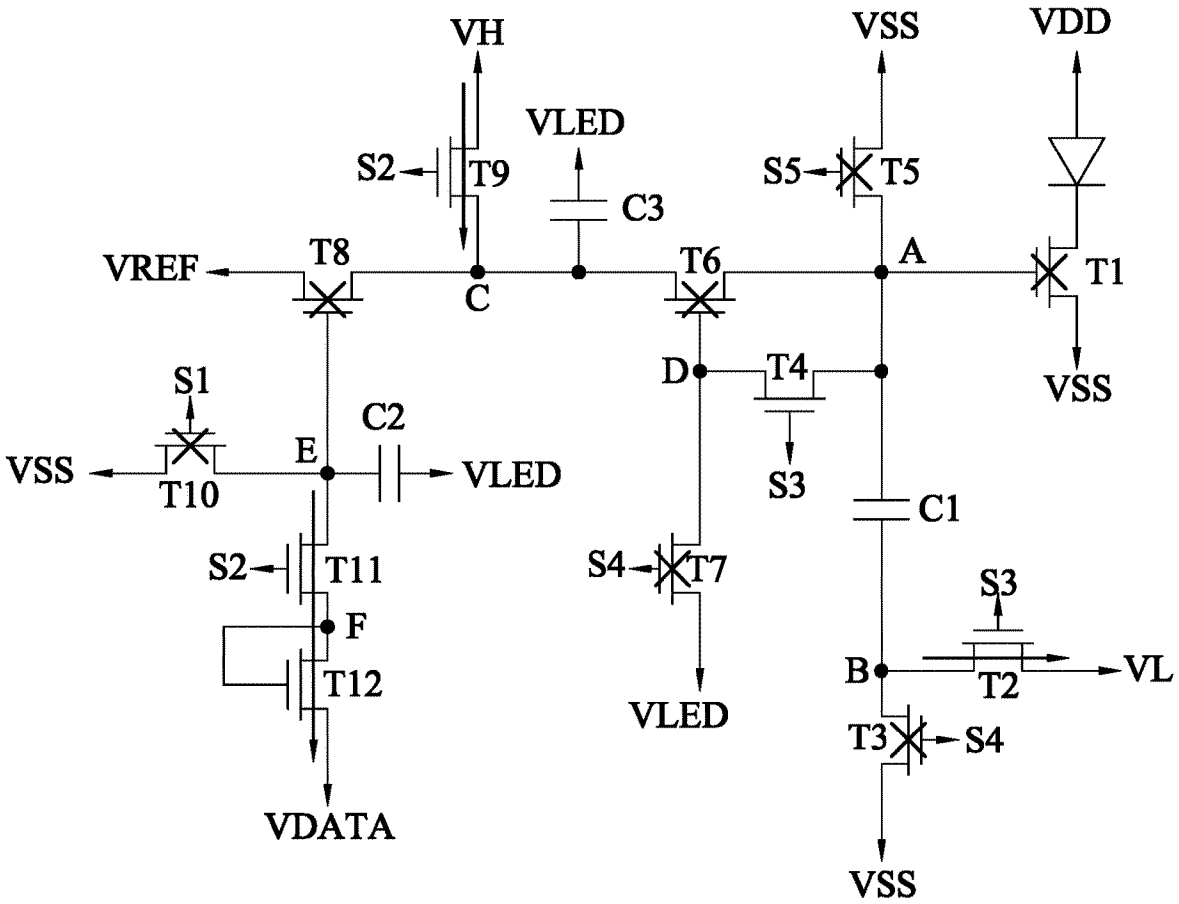
FIG. 5 is a schematic diagram illustrating an operation of the pixel compensation circuit illustrated in FIG. 1 in the time interval illustrated in FIG. 2.

Reference is made to FIG. 5. FIG. 5 is a schematic diagram illustrating an operation of the pixel compensation circuit 100 illustrated in FIG. 1 in the time interval TP3 illustrated in FIG. 2. The time interval TP3 is the compensation time interval. In the time interval TP3, the control signals S2, S3 are the high voltage values VGH, the control signals S1, S4, S5 are the low voltage values VGL, and the reference voltage source VREF is the high voltage value VREF_H.

Since the control signals S1, S4, S5 are the low voltage values VGL, the transistors T3, T5, T7 and T10 are not conducted. Since the control signals S2, S3 are the high voltage values VGH, the transistors T4, T9, T11 and T12 are conducted. The voltage value of the node C is the voltage value V_H of the high voltage source VH. The current flows from the node E to the voltage source VDATA. The voltage value of the node E is the voltage value V_DATA of the voltage source VDATA plus the threshold voltage VTH_T12 of the transistor T12. At this time, the transistor T12 matches and compensates the threshold voltage of the transistor T8. Moreover, since the transistor T2 is conducted, the voltage value of the node B is the voltage value V_L of the high voltage source VL.

Figure 6:
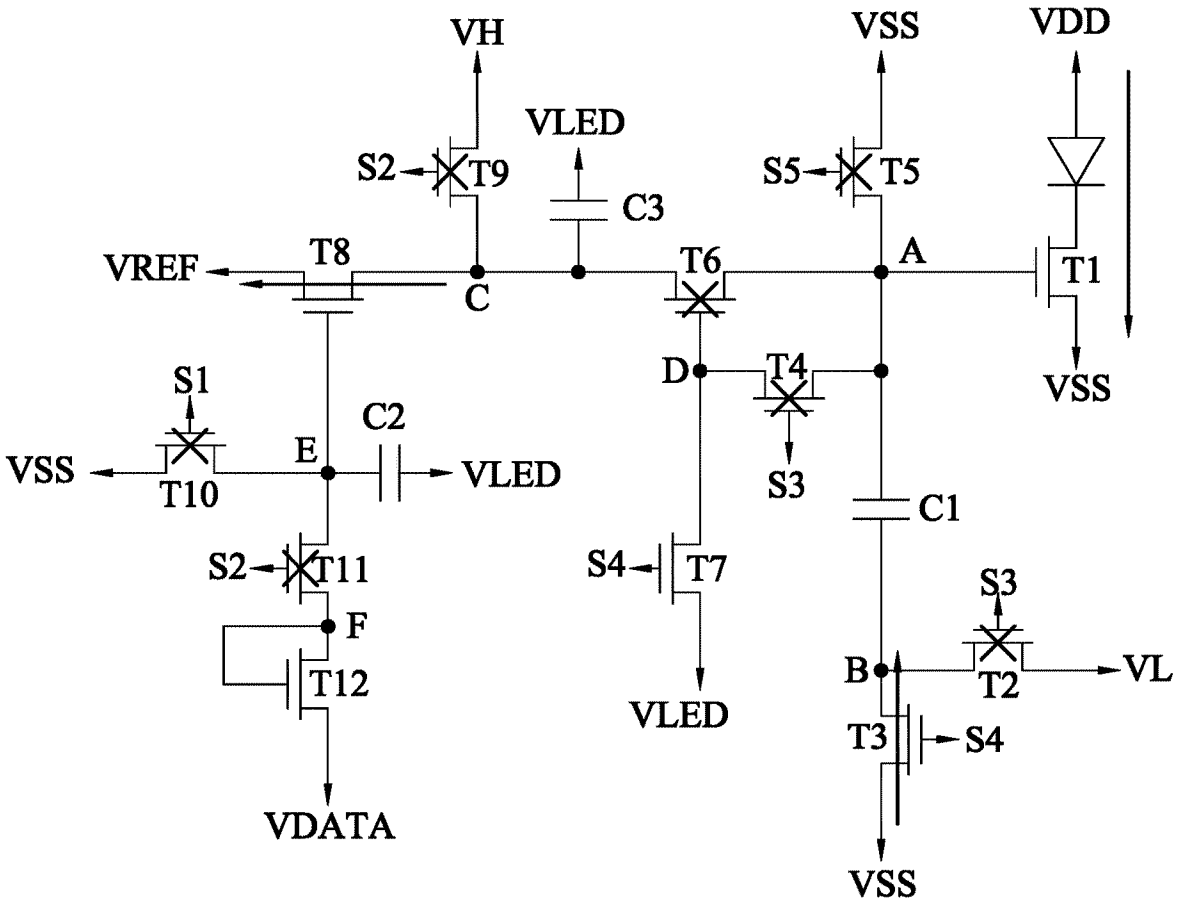
FIG. 6 is a schematic diagram illustrating an operation of the pixel compensation circuit illustrated in FIG. 1 in the time interval illustrated in FIG. 2.

Reference is made to FIG. 6. FIG. 6 is a schematic diagram illustrating an operation of the pixel compensation circuit 100 illustrated in FIG. 1 in the time interval TP4 illustrated in FIG. 2. The time interval TP4 is the luminous time interval.

In the time interval TP4, the voltage value of the control signal S4 is the high voltage value VGH, and the voltage values of the control signals S1, S2, S3 and S5 are low voltage values VGL. The reference voltage source VREF is a low voltage value VREF_L.

Since the voltage values of the control signals S1, S2, S3, S5 are low voltage values VGL, the transistors T2, T4, T5, T9, T10 and T11 are not conducted. Since the voltage value of the control signal S4 is the high voltage value VGH, the transistors T3 and T7 are conducted. The voltage value of the node B increases from V_L to V_SS. Since node A is floating, at this time, the voltage value of the node A is V_SS−V_L+VREF_H+VTH_T6. The transistor T1 is conducted.

After the transistor T1 is conducted, the current value of the current flowing through the light emitting diode 105 is 0.5 k(VREF_H−V_L)2.

Since the voltage value of the node E is V_DATA+VTH_V12, and the reference voltage source VREF is a low voltage value VREF_L, the transistor T8 is conducted. After the transistor T8 is conducted, the current flows from the node C to the reference voltage source VREF. At this time, the current value flowing through the transistor T8 is 0.5 k(V_DATA−VREF_L)2. The constant current flowing through the transistor T8 discharges the node C, and the voltage value of the node C gradually decreases.

Figure 7:
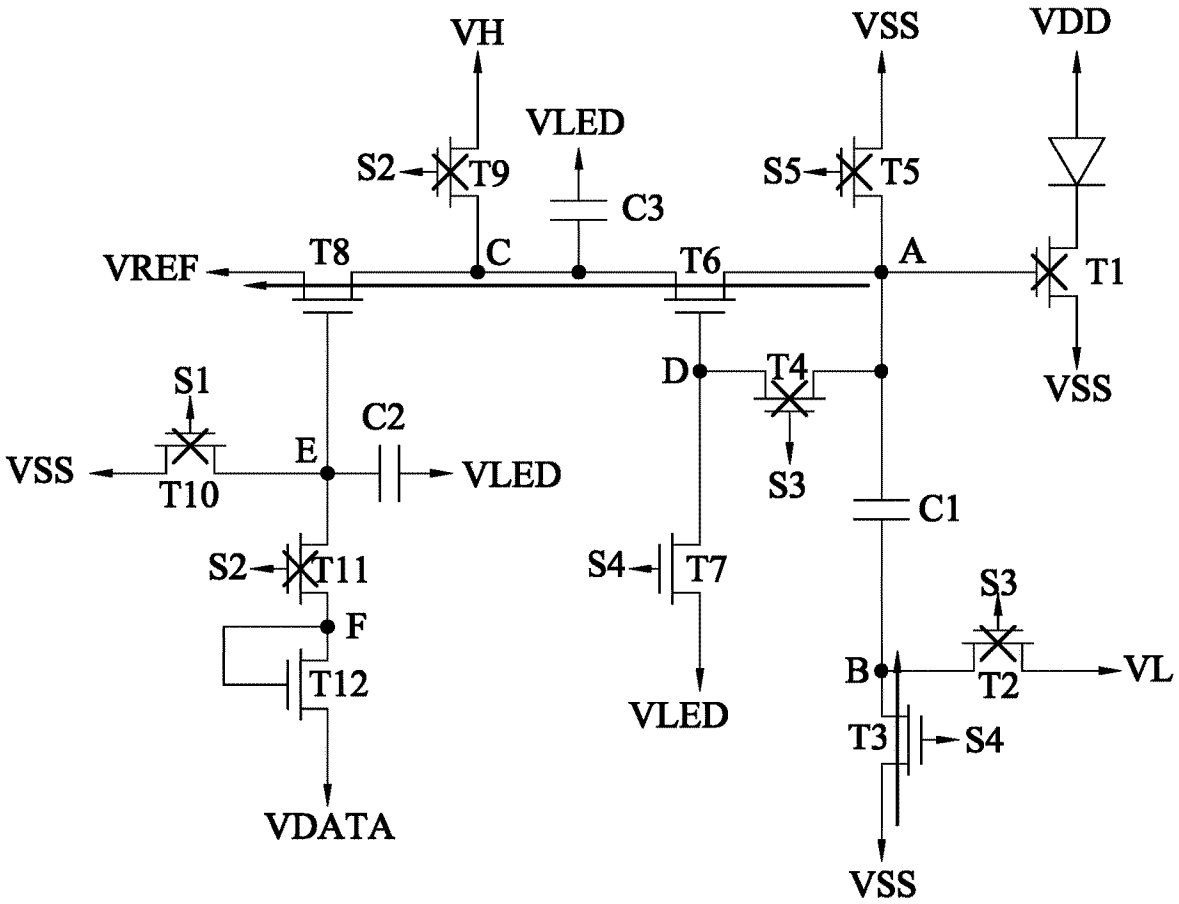
FIG. 7 is a schematic diagram illustrating an operation of the pixel compensation circuit illustrated in FIG. 1 in the time interval illustrated in FIG. 2.

Reference is made to FIG. 7. FIG. 7 is a schematic diagram illustrating an operation of the pixel compensation circuit 100 illustrated in FIG. 1 in the time interval TP4 illustrated in FIG. 2. Continuing the operation of FIG. 6. When the voltage value of the node C gradually decreases to a voltage value lower than the voltage value of node D minus the threshold voltage VTH_T6 of the transistor T6, the transistor T6 enters the linear region. At this time, the voltage value of the node A is equal to the voltage value of the node C. The voltage value of the node C is V_H minus ΔV. ΔV is the voltage value variation of the node C discharged by the current flowing through the transistor T8 which causes the node C to drop.

After the transistor T6 is conducted, the voltage value of the node A gradually decreases, when the voltage value of the node A is smaller than the voltage value V_SS plus the threshold voltage VTH_T1 of the transistor T1, the transistor T1 turns off.

The constant current flowing through the transistor T8 continuously discharges the node C, until the voltage value of the node C reaches the VREF_L plus the threshold voltage VTH_T8 of the transistor T8.

According to the paragraphs mentioning above, the voltage value V_DATA affects the constant current flowing through the transistor T8, and the voltage drop time of the node A is further affected. By controlling the voltage drop time of the node A, the gray scale of the light emitting diode 105 can be controlled.

Reference is made to FIG. 2 again. In the time interval TP5, the control signals S1, S2, S4 are low voltage values VGL, and the control signals S3, S5 are high voltage values VGH, the reference voltage source VREF is a high voltage value VREF_H. The time interval TP5 is the same as the time interval TP1, both of them are the reset time interval, and the operation of the time interval TP5 is the same as that of the time interval TP1, and will not be repeated here.

In practice, the transistors T1 to T12 in FIG. 1 can be implemented by P-type low-temperature polysilicon thin film transistors, but the embodiments of the present disclosure are not limited thereto. For example, the transistors T1 to T12 can also be implemented by P-type amorphous silicon thin film transistors. In some embodiments, N-type thin film transistors can also be used for implementation, and the transistor types are not limited in the embodiments of the present disclosure.

The embodiments of the present disclosure are to provide a 12T3C circuit architecture, which is applied to Mini LED backlight panels. In the embodiments of the present disclosure, the light emitting time of the light emitting diode is determined by the discharge through the constant current to control the gray scale of the light emitting diode. And by reducing the number of transistors on the light-emitting path, the VDD-VSS cross voltage required by the circuit can be reduced, in order to achieve the highest luminous efficiency of the light emitting diode and to reduce the power consumption. In addition, by compensating for the threshold voltage variation of the transistor and the IR increase of VSS, the light-emitting current can be more accurate.

Although the present invention has been described in considerable detail with reference to certain embodiments thereof, other embodiments are possible. Therefore, the scope of the appended claims should not be limited to the description of the embodiments contained herein.

What is claimed is:

1. A pixel compensation circuit, comprising:
- a light emitting diode;
- a drive unit, connected to the light emitting diode and a first node;
- a control unit, connected to the first node;
- a data write-in unit, connected to the control unit;
- a reset unit, connected to the first node; and
- a pull-down unit, connected to the control unit;
- wherein the control unit is further configured to control a voltage drop time of the first node according to a data voltage value received by the data write-in unit, so as to control a gray scale of the light emitting diode;
- wherein the data write-in unit comprises:
  - a first transistor, wherein a first end of the first transistor is connected to a first voltage source, a second end of the first transistor is connected to a second node;
  - a second transistor, wherein a first end of the second transistor is connected to the second node, a second end of the second transistor is connected to a third node;
  - a third transistor, wherein a first end and a control end of the third transistor are connected to the third node, and a second end of the third transistor is connected to a data input source; and
  - a first capacitor, wherein a first end of the first capacitor is connected to the second node, and a second end of the first capacitor is connected to a first reference voltage source.

2. The pixel compensation circuit as claimed in claim 1, wherein in a reset time interval, the reset unit is further configured to reset a voltage value of the first node.

3. The pixel compensation circuit as claimed in claim 1, wherein the drive unit comprises:

a fourth transistor, a first end of the fourth transistor is connected to the light emitting diode, a second end of the fourth transistor is connected to the first voltage source, and a control end of the fourth transistor is connected to the first node.

4. The pixel compensation circuit as claimed in claim 3, wherein the pull-down unit comprises:

a fifth transistor, wherein a first end of the fifth transistor is connected to a low voltage source, a second end of the fifth transistor is connected to a fourth node; and a sixth transistor, wherein a first end of the sixth transistor is connected to the fourth node, and a second end of the sixth transistor is connected to the first voltage source.

5. The pixel compensation circuit as claimed in claim 4, wherein the reset unit further comprises:

a seventh transistor, wherein a first end of the seventh transistor is connected to the first voltage source, and a second end of the seventh transistor is connected to the first node.

6. The pixel compensation circuit as claimed in claim 5, wherein the control unit further comprises:

an eighth transistor, wherein a first end of the eighth transistor is connected to the first node, and a second end of the eighth transistor is connected to a second node;

a ninth transistor, wherein a first end of the ninth transistor is connected to the first node, a second end of the ninth transistor is connected to a third node, and a control end of the ninth transistor is connected to the second node;

a tenth transistor, wherein a first end of the tenth transistor is connected to the first reference voltage source, and a second end of the tenth transistor is connected to the second node;

an eleventh transistor, wherein a first end of the eleventh transistor is connected to the third node, a second end of the eleventh transistor is connected to a second reference voltage source, and a control end of the eleventh transistor is connected to the second node;

a twelfth transistor, wherein a first end of the twelfth transistor is connected to a high voltage source, and a second end of the twelfth transistor is connected to the third node;

a second capacitor, wherein a first end of the second capacitor is connected to the fourth node, a second end of the second capacitor is connected to the fourth node; and a third capacitor, wherein a first end of the third capacitor is connected to the third node, and a second end of the third capacitor is connected to the first reference voltage source.

7. The pixel compensation circuit as claimed in claim 6, wherein in a reset time interval, the eighth transistor and the seventh transistor are conducted so as to reset a voltage value of the first node to a voltage value of the first voltage source.

8. The pixel compensation circuit as claimed in claim 6, wherein in a first compensation time interval, the second reference voltage source is a high voltage value, the first transistor and the eighth transistor are conducted, so that the ninth transistor and the eleventh transistor are conducted, and the ninth transistor is utilized to compensate a threshold voltage of the fourth transistor.

9. The pixel compensation circuit as claimed in claim 8, wherein in a second compensation time interval, the fifth transistor, the eighth transistor, the twelfth transistor, the second transistor and the third transistor are conducted, and the third transistor is utilized to compensate a threshold voltage of the eleventh transistor.

10. The pixel compensation circuit as claimed in claim 6, wherein in a luminous time interval, the eleventh transistor is conducted, so that a voltage value of the third node gradually decreases to conduct the ninth transistor, after the ninth transistor is conducted, a voltage value of the first node gradually decreases, when the voltage value of the first node is smaller than a conduction threshold, the fourth transistor is turned off, so that the light emitting diode is not conducted.

* * * * *